US005496449A

United States Patent [19]

Ishibashi et al.

[11] Patent Number: 5,496,449

[45] Date of Patent: Mar. 5, 1996

[54] METHOD OF TREATING SALT BATH LIQUID

[75] Inventors: Tadaya Ishibashi, Suita; Masanori Sasaki, Okazaki; Hideto Obara, Uji; Hiroshi Kano, Uji; Shintaro Yamashita, Uji, all of Japan

[73] Assignee: Unitika, Ltd., Japan

[21] Appl. No.: 274,903

[22] Filed: Jul. 14, 1994

Related U.S. Application Data

[62] Division of Ser. No. 812,627, Dec. 23, 1991, Pat. No. 5,348,628.

[30] Foreign Application Priority Data

Apr. 2, 1991 [JP] Japan ..... 3-68649
May 31, 1991 [JP] Japan ..... 3-128069

[51] Int. Cl.[6] ..... B01D 61/44; B08B 7/04; C02F 1/46; C23G 1/36

[52] U.S. Cl. ..... 205/762; 204/520; 134/2; 134/10; 205/770

[58] Field of Search ..... 134/2, 10; 204/151, 204/153, 182.4, 182.5

[56] References Cited

U.S. PATENT DOCUMENTS

| | | | |
|---|---|---|---|
| 2,865,823 | 12/1958 | Harris et al. | 204/151 |
| 3,394,068 | 7/1968 | Calmon et al. | 204/182.4 |
| 3,761,369 | 9/1973 | Tirrell | 204/182.4 X |
| 3,764,503 | 10/1973 | Lancy et al. | 204/151 X |
| 3,933,605 | 1/1976 | Butler | 134/10 X |
| 3,969,207 | 7/1976 | Kerti et al. | 204/151 X |

(List continued on next page.)

FOREIGN PATENT DOCUMENTS

| | | | |
|---|---|---|---|
| 565405 | 10/1958 | Canada | 204/182.4 |
| 0023184 | 1/1981 | European Pat. Off. . | |
| 0075882 | 4/1983 | European Pat. Off. . | |
| 0164437 | 12/1985 | European Pat. Off. . | |
| 2207201 | 7/1974 | France . | |
| 3906791 | 9/1990 | Germany | 204/182.4 |
| 1130706 | 5/1989 | Japan | 204/182.4 |
| 252361 | 10/1948 | Switzerland . | |

OTHER PUBLICATIONS

European Search Report, Form 1503 03.82 (P04C01) dated Jul. 7, 1992.
Abstract for FR–A–2 207 201.
Abstract for EP–A–0 023 184.
Abstract for EP–A–0 164 437.

*Primary Examiner*—John Niebling
*Assistant Examiner*—J. Starsiak
*Attorney, Agent, or Firm*—Barnes, Kisselle, Raisch, Choate, Whittemore & Hulbert

[57] ABSTRACT

The present invention relates to the method of treating the salt bath liquid. In the surface treatment of the steel material by the use of the high-temperature salt bath mainly comprising sodium hydroxide and sodium nitrate, the salt ingredients contained in the washings generated are separated to be recovered and the metal salts contained are separated in the form of the insoluble salts. The salts contained in the nitrate radical-containing liquid system are recovered as the free acids again, the alkalies being recovered, and the reagents contained in the overflow from the salt-washing tank being recovered. The anode chamber liquid generated in the recoverying operation of the reagents is returned to the washing tank again to increase the concentration of the salts. The anode chamber liquid is poured into the pickling tank to reduce the oxidizing soluble metal salts contained in the washings by iron within the pickling tank, whereby the oxidizing soluble metal salts are insolubilized. The mixture liquid of the overflows from the respective tanks and the washing water for removing the foreign matters in the salt bath is mixed with the nitric acid-containing liquid for pickling the steel material and then sodium hydroxide is supplied to alkalize. Thus, the dissolved metal compounds in the liquids, which have been used for the treatment, are separated into the insoluble solid metal hydroxides and the liquid of the soluble salts without mixing the insoluble alkalies.

2 Claims, 5 Drawing Sheets

U.S. PATENT DOCUMENTS

| | | | |
|---|---|---|---|
| 4,071,431 | 1/1978 | Nicou et al. | 204/151 X |
| 4,144,145 | 3/1979 | Watanabe et al. | 204/182.4 X |
| 4,149,946 | 4/1979 | Burke | 204/182.4 |
| 4,210,502 | 7/1980 | Watanabe et al. | 204/182.4 X |
| 4,455,251 | 6/1984 | Wood et al. | 252/156 |
| 4,943,360 | 7/1990 | Sugisawa et al. | 204/182.4 X |
| 5,244,551 | 9/1993 | Brücken et al. | 204/182.4 X |

METHOD OF TREATING SALT BATH LIQUID

This is a divisional of application Ser. No. 07/812,627 filed on Dec. 23, 1991, now U.S. Pat. No. 5,348,628.

FIELD OF THE INVENTION

The present invention relates to a method of treating salt bath liquid, and more particularly to a method of treating salt bath liquid in which free alkalis and neutral salts coexist in high concentrations. The present invention is an improvement applicable to the treatment of waste liquid resulting from the quenching of stainless steel, etc. subjected to salt bath heat treatment, and in particular the invention concerns itself with the treatment of waste liquid resulting from the work of washing off salts which stick to the surface of steel.

BACKGROUND OF THE INVENTION

It is well known that salt bath liquid, in which steel such as stainless steel is immersed for the purpose of descaling, contains nitric acid radicals and toxic chromates in high concentrations. In order to isolate the metallic salts, it is most common to make the liquid strongly acidic, and then add a strong reducing agent so as to allow the acidic liquid to resume alkalinity. However, this prior art method has drawbacks which limit its utility. Firstly, the reducing agent involved is relatively expensive and yet it is not recovered. Secondly, the cumbersome and time-consuming character of the above-described procedures results in high costs.

A great convenience will be afforded to the isolation of salt radicals contained in the waste liquid, if these salt radicals are converted into insoluble matters as a result of reacting on a compound added to the waste liquid. However, it is difficult to come upon such a compound, and the technique which can be put to practical use for the isolation of salt radicals from the waste liquid has not been proposed as yet.

When the waste liquid contains free alkalis of especially high concentration and soluble metallic salts of considerably high concentration, it is most common to adjust the pH-value of the waste liquid in order to convert metal ions into insoluble matters with a view to isolating them from the waste liquid. In order to adjust pH-value of waste liquid, it is known to add a large quantity of an acid not only to neutralize the alkalis but even to make the liquid acidic, and then to add a strong reducing agent so as to decrease the valencies of metals.

Japanese Patent Unexamined Publication No. 2-145786 describes a method of recovering free acids from used pickling liquor, wherein a semipermeable membrane is used for the purpose of recovery. The reducing power of ferrous ions ($Fe^{++}$) remaining in the used pickling liquor is utilized.

Apart from this prior art method, it is always desirable to provide a method of effectively removing metallic salts coexisting with a large quantity of nitric acid radicals in waste liquid discharged from a salt bath furnace.

When steel is immersed in salt bath liquid for the purpose of surface treatment, a reaction product collects on the surface of the steel. After taking out the steel from the salt bath furnace, the reaction product has to be removed with a large quantity of water.

In current practice, the salt bath liquid for the surface treatment of steel consists of sodium hydroxide and sodium nitrate, with the equivalent ratio of sodium hydroxide to sodium nitrate substantially falling within the range between 6:4 and 7:3. This means that sodium hydroxide prevails over sodium nitrate. Furthermore, the gram equivalent of sodium hydroxide tends to be larger than the total amount of acid radicals used in the surface treatment process. For these reasons, industrial sewage tends to be a considerably strong base, which has to be neutralized by an expensive acid.

The trouble is that not only an expensive agent but also chromic ions and manganous ions dissociated from steel are contained in high concentrations in waste water discharged from the site of the above-mentioned rinsing process. In order to remove these components, an expensive acid has to be added in the first place so as not only to neutralize alkaline components existing in large quantities but even to make the waste water acidic, and then a strong reducing agent has to be added to the acidic waste water so as to decrease the valencies of metals, allow the acidic waste water to resume alkalinity, and convert the metal ions into insoluble matters so that they may be isolated from the waste water.

The cumbersome and time-consuming character of the above-described procedures not only results in high costs but also poses the following problems:

A) A large quantity of expensive sodium hydroxide is neutralized simply to produce a salt of little value and usefulness. No one has been thoughtful enough to think of a method of effectively recovering the expensive sodium hydroxide.

B) In addition to sodium hydroxide, industrial sewage contains nitrates, which in turn contain a large quantity of nitric acid radicals. Consequently, the quantity of industrial sewage which can be discharged into sewer pipes is subject to regulation, although there are regional differences in the severity of regulation. It is keenly desirable, therefore, to provide a method by which nitric acid radicals can be effectively removed before the industrial sewage is discharged into sewer pipes. Since nitric acid radicals are a relatively expensive agent, they are worth being isolated for the purpose of recycling them as nitric acid. If the above-described acid bath liquid is subjected to electrolysis, not only metals but also sodium, which has reacted on nitric acid radicals, will be removed.

C) The above-described acid bath liquid further contains a large quantity of toxic chromates and manganates, which have to be removed for the prevention of environmental pollution. In order to remove these metallic salts, they have to be converted into insoluble matters. For this purpose, the largest expenses quota has to be given to the purchase of an acid to be used for neutralizing the alkalis coexisting with the metallic salts. Thus the problem mentioned in this paragraph and the problem mentioned in paragraph A) are inseparably related to each other.

When, in an acidic atmosphere, ferrous ions ($Fe^{++}$) coexist with metal ions which remain in a dissolved state even in an alkaline atmosphere, a simplified process of reducing such metal ions is available. Since each $Fe^{++}$ loses one electron when it is oxidized to $Fe^{+++}$, all that has to be done is to allow the metal ions to gain electrons so as to allow these metal ions to decrease valencies.

Whether or not this simplified process comes off well depends upon the conditions of pickling liquor in a pickling bath incorporated in the same production line as the salt bath furnace involved. The conditions to be fulfilled by the pickling liquor are that it should contain 0.7 to 1.0N free acid radicals so as to be strongly acidic, that it should be kept at 40° to 60° C. so as to allow the reaction to smoothly proceed, and that it should contain a large quantity of $Fe^{++}$ required as a reducing agent. For the effective pickling of stainless steel, a pickling agent should preferably contain both $Fe^{++}$ and $Fe^{+++}$ in a suitable ratio. If the above-described conditions of pickling liquor are fulfilled, they will obviate the necessity of purchasing an expensive reducing agent and having trouble with where to dump the sludge resulting from the reducing process.

On many occasions, the process of reducing $Cr^{6+}$ to $Cr^{+}$ by $Fe^{++}$ is allowed to proceed in a bath liquid in which stainless steel is descaled. It has been found that on such occasions a change in the characteristics of metal surfaces is caused by reduced chromium, which sticks to the surfaces of activated metal at the time of descaling.

Salt radicals, of which the salt bath liquid is composed, cannot be converted into insoluble matters even if they are neutralized, in spite of the fact that these salt radicals have to be removed from the waste liquid in order to prevent the eutrophication of lakes.

Sodium nitrate, which is the chief ingredient of the salt bath liquid, is soluble. Enrichment is the only method of removing sodium nitrate from the waste liquid. Enriched sodium nitrate cannot be recycled until it is converted into an anhydrous salt.

Furthermore, the high-temperature salt bath converts chromium molecules, which are one of the ingredients of stainless steel, into $Cr^{3+}$ and further into water-soluble and toxic $Cr^{6+}$, which gives rise to a problem in connection with the disposal of industrial waste matter.

In order to remove $Cr^{6+}$, it is most common to reduce $Cr^{6+}$ to $Cr^{3+}$ by a reducing agent and allow the ions to cohere. However, the technique which can be put to practical use for the removal of nitric acid radicals from the waste liquid has not been proposed as yet.

It has also been proposed to use a ferrous salt as a reducing agent for reducing $Cr^{6+}$ to $Cr^{3+}$.

Japanese Patent Application No. 63-9880 describes a method of recovering free acids from a used pickling liquor, wherein a semipermeable membrane is used for the purpose of recovery. Waste liquid, the chief ingredient of which is metallic salts, is utilized as a reducing agent. However, this Application does not show a method of enriching the nitric acid radicals contained in the quenched waste liquid and recovering free nitric acid and sodium hydroxide so that they can be recycled.

Chemicals contained in salt bath liquid are relatively expensive. Furthermore, it is difficult to isolate them from the waste liquid.

In current practice, acid bath liquid containing nitric acid as a chief ingredient is simply neutralized and discarded. However, a portion of iron contained in this kind of acid bath liquid is an effective reducing agent which acts on $Cr^{6+}$. An effective utilization of this portion of iron will result in a curtailment of the expenses quota to be given to the purchase of a chemical agent for reducing $Cr^{6+}$.

SUMMARY OF THE INVENTION

It is an object of the present invention to provide a method of recovering chemicals in a state of high purity from rinsing water used for rinsing the surfaces of steel subsequently to the immersion of the steel in hot alkaline bath liquid. It is another object of the present invention to provide a method by which the characteristic of a substance contained in bath liquid can be utilized for improving the corrosion resistance of steel and for obviating the necessity of purchasing a chemical agent having the same characteristic as the substance contained in the bath liquid.

In accordance with the present invention, a substance to be used for reducing toxic chromates may be obtained from a nearby operating line. On the other hand, free acids and alkaline agents are recovered from waste liquid containing salts and nitric acid radicals.

To put it concretely, the following are the objects of the present invention:

a) To provide a method of efficiently isolating free sodium hydroxide from the above-described rinsing water so that the isolated sodium hydroxide may be recycled and the necessity of purchasing an acid to be added for the purpose of neutralization may be obviated.

b) To provide a method by which $Na^{+}$ remaining as the cations of sodium nitrate in the rinsing water after the isolation of free sodium hydroxide can be removed.

c) To provide a method by which metal ions remaining in the rinsing water after the isolation of free sodium hydroxide can be reduced so as to be easily removed.

In accordance with the present invention, a rinsing tank is partitioned into a plurality of compartments. Rinsing water in each compartment contains suspended matter, which is removed by a filter. Then, this rinsing water is delivered through a first set of nozzles so as to be directed against steel to be rinsed. The rinsing tank is replenished with fresh rinsing water, which is mixed with compressed air. The mixture is delivered through a second set of nozzles so as to be directed against the steel which has just been rinsed. The second set of nozzles is subjected to reciprocating motion in a direction perpendicular to the feed direction of the steel. The rinsing tank is of counterflow multiwash type such that a portion of rinsing water is discharged at one end of the rinsing tank where there is arranged a means for receiving the steel to be rinsed, and fresh rinsing water is supplied at the other end of the rinsing tank where the steel which has been rinsed is delivered to a succeeding process. The steel is so hot as to vaporize the rinsing water sprayed against the steel. As a result of this vaporization, the rinsing water in the rinsing tank is enriched and decreases in quantity. In order to make up for this loss in quantity, the above-described waste water is recycled after the isolation of free sodium hydroxide.

In accordance with the present invention, salts in the waste water are forcibly dissociated and are allowed to come in contact with an ion exchange membrane which selectively allows only cations to pass through it so that the cations may be isolated from anions and the anions may be allowed to remain in high purity.

The above-described forcible dissociation of salts and the isolation of cations are applicable to the treatment of waste liquid resulting from a batch process of immersing the products in salt bath liquid in a hoop mill, a bar mill or a looping mill, and from a batch process wherein small articles placed in one basket after another are immersed in salt bath liquid.

Thus the present invention can be used for isolating free alkalis from salt bath liquid in which free alkalis and neutral salts coexist in high concentrations. Neutral salts remaining in the salt bath liquid are dissociated into anion acids and cation bases in a succeeding process where soluble metallic salts are to be converted into insoluble matters.

The present invention can be further used for recovering the agents from water in which hot steel has been cooled after the surface treatment carried out in salt bath liquid, from waste liquid resulting from the neutralization of alkalis sticking to the surfaces of the cooled steel, and from waste liquid resulting from the work of washing off the components of salt bath liquid sticking to the slag at the bottom of the salt bath furnace. Prior to the above-described recovery of agents, chromium compounds dissociated from steel and converted into $Cr^{6+}$ in the salt bath liquid are reduced to insoluble hydroxides. For this purpose, a portion of used pickling liquor containing metal ions and free acids is injected into the neutralized waste liquid. At a high temperature and in an acidic condition, hexatomic salts contained in the waste liquid are reduced to trivalent salts. Then the acidic liquid is allowed to resume alkalinity by sodium hydroxide so that the necessity of adding an insoluble alkaline agent may be obviated in converting metal ions into insoluble metal hydroxides and isolating them from soluble salts such as sodium nitrate and sodium hydroxide.

One should pay attention to the following features of salt bath liquid:

(A) The chief ingredients of the salt bath liquid are sodium hydroxide and sodium nitrate. Metal ions dissociated from steel are contained in high concentrations.

(B) Since the salt bath liquid is held at 400° C. to 600° C., chromium compounds dissociated from steel are dissolved in a stable hexatomic state.

(C) Other metallic salts also exist. These compounds are carried by quenching water to one end of the rinsing tank where waste water is discharged. Except hexatomic chromium, they are insoluble matters. In brief, the salt bath liquid is composed of:

a) Soluble neutral salt, i.e., sodium nitrate;

b) Alkaline agent, i.e., sodium hydroxide; and c) Dispersoids, i.e., metal oxides and metal hydroxides.

(D) On many occasions, a nitric acid bath is attached to a salt bath in a plant where stainless steel is subjected to surface treatment. Nitric acid bath liquid must be discarded when metals are dissociated from stainless steel to such an extent that the nitric acid bath is made functionally useless thereby. However, this bath liquid contains ferrous ions ($Fe^{++}$) having a reducing power strong enough to reduce hexatomic chromium to an innoxious hydroxide.

There are some cases where acid bath liquid and rinsing water contain a useful agent or agents other than mentioned above.

Even after the reducing process, metal ions remain in the waste liquid. By adding an alkaline agent, they can be converted into insoluble metal hydroxides.

It is of paramount importance to take care not to add a more alkaline agent than actually required.

Insoluble impurities will be produced if an alkaline agent is added excessively. These insoluble impurities will hinder the recycling of metal hydroxides. As an attempt to solve this problem, the present invention provides a method of recycling sodium hydroxide and takes advantage of the fact that soluble salts can be dissociated into free acids and alkalis by ionization.

Thus a large quantity of a valuable metallic compound contained in the waste liquid can be recycled as an agent for reducing $Cr^{6+}$ to $Cr^{3+}$ and isolating the metallic salts. The cost required for purchasing an expensive agent for such reduction and isolation can be cut down thereby.

To put it concretely, soluble hexatomic chromium dissociated from sodium chromate is made innoxious and converted into an insoluble matter by means of the acid bath liquid mentioned above in paragraph (D), and salts are isolated and recovered from the acid bath liquid.

An apparatus suitable for dissociating a salt into cations and anions includes a cylindrical positive electrode and a cylindrical negative electrode set in position. A plurality of oxidation-resistant ion exchange membranes having a low electric resistance are interposed between the electrodes so that an anode compartment may be separated from a cathode compartment. Alkaline liquid is fed to a cell disposed near the anode compartment. The cations are subjected to electrophoresis from the anode compartment to the cathode compartment and collects in the latter.

Consequently, free nitric acid is produced in the anode compartment. There may be some cases where, because of a low concentration, this nitric acid is precluded from being recycled. In such a case, low-concentration nitric acid is fed to another cell disposed near the anode compartment and refluxed to the anode compartment after enrichment.

Current efficiency in ionization in accordance with the present invention is so high that there is hardly a difference between the cost required for dissociating the soluble salts into free acids and alkalis by ionization in accordance with the present invention and the cost required for purchasing free acids and alkalis.

In brief, the present invention resides in providing a method of recovering salts from waste liquid discharged from a rinsing tank to which steel such as stainless steel is advanced when it has been subjected to salt bath heat treatment. Toxic metallic salts contained in this waste liquid cannot be isolated as sediments unless they are reduced. For the purpose of this reduction, iron salts accumulated in pickling liquor in a pickling bath incorporated in the same production line as the salt bath furnace involved are utilized. The above-described toxic metallic salts can be removed by means of an electrolyzer provided for removing metallic salts accumulated in the pickling liquor. Consequently, as compared with known methods, the expected quantity of chemicals required for removing the toxic metallic salts can be drastically curtailed. The discharge of nitric acid radicals, which cannot be converted into an insoluble matter, can be inhibited.

In accordance with the present invention, concentrated sodium nitrate produced during the salt bath heat treatment of stainless steel can be recovered and utilized as a component of pickling liquor. An agent for reducing $Cr^{6+}$ to $Cr^{3+}$ and an agent for isolating insoluble matters can be obtained from one and the same waste liquid.

DESCRIPTION OF PREFERRED EMBODIMENTS

Figure 1:
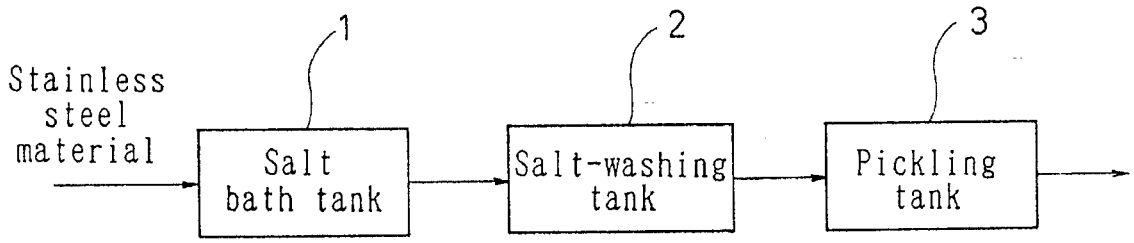
FIG. 1 is a diagram for the principle of operation in accordance with the present invention.

1) As is indicated in FIG. 1 of the drawings, steel such as stainless band steel is immersed in salt bath liquid contained in a salt bath furnace 1, and advanced to a rinsing tank 2 of multiwash type. Salts, which stick to the surfaces of the steel, are removed from the surfaces of the steel and dissolved in rinsing water. The steel is further advanced to a pickling bath 3.

2) In this specification, all parts, proportions, percentages and ratios are on a weight basis. The composition of the salt bath liquid is 65% solid sodium hydroxide and 35% solid sodium nitrate heated to and held at a temperature ranging from 400° C. to 600° C. so as to be allowed to remain in a molten state. With the lapse of time, the salt bath liquid decreases in quantity because it sticks to the surfaces of the steel and is taken out of the salt bath furnace 1. In order to make up for this loss in quantity, the salt bath furnace 1 is replenished with solid salts mixed in the same mixing ratio as mentioned above.

Figure 2:
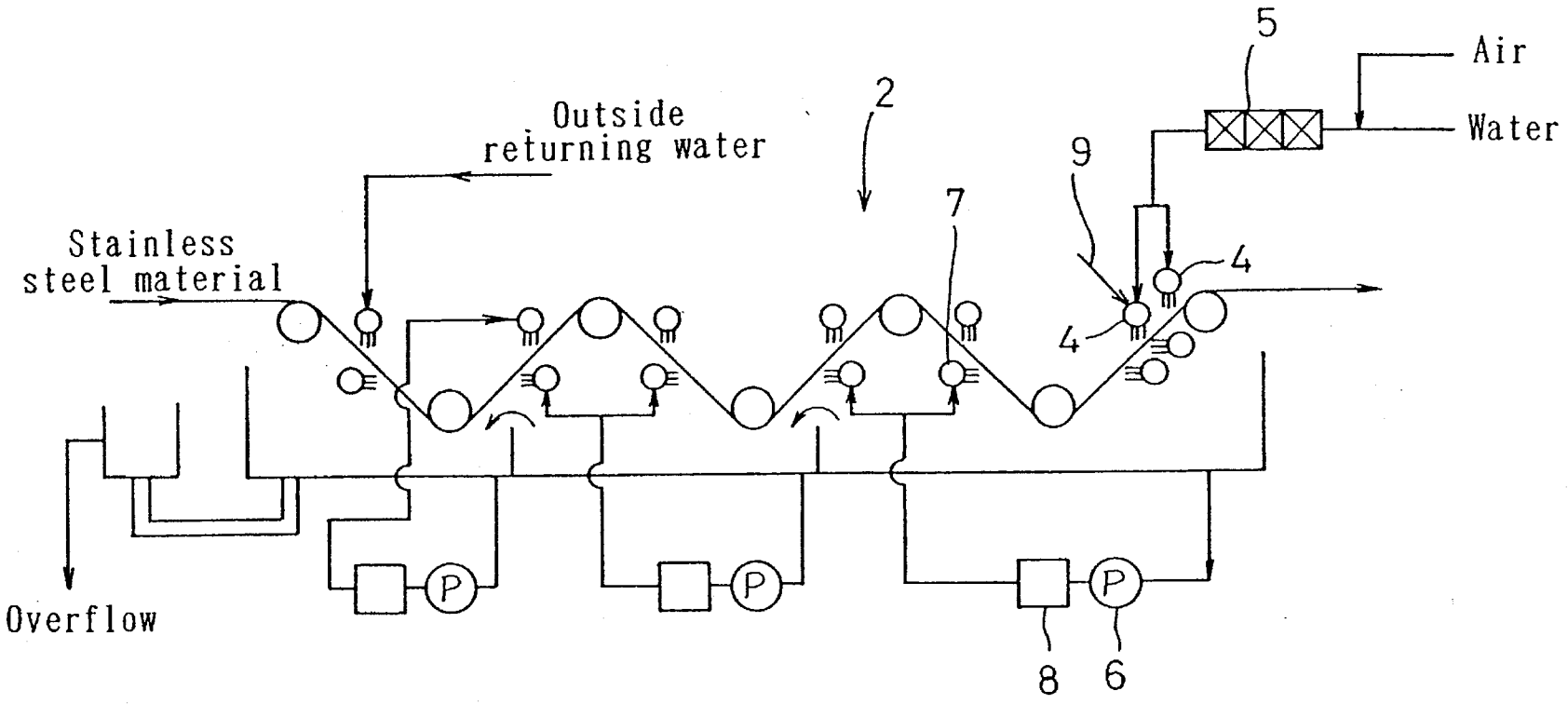
FIG. 2 is a view illustrating the construction of the rinsing tank included in FIG. 1.

3) FIG. 2 illustrates the construction of the multiwash type rinsing tank 2.

By way of example, band steel which is 600 mm wide and 1 mm thick is fed to the salt bath furnace 1, rinsing tank 2 and pickling bath 3 at a feed speed of 6 meters per minute.

As shown in FIG. 2, the rinsing tank 2 is partitioned into three compartments and is of counter-flow multiwash type such that waste water is discharged at one end of the rinsing tank 2 where there is arranged a means for receiving the band steel to be rinsed, and fresh rinsing water is supplied at the other end of the rinsing tank 2 where the band steel which has been rinsed is delivered to the succeeding process. Nozzles 4 having a bore diameter of 0.6 mm are provided at the delivery side of the rinsing tank 2 and supplied with a mixture of water and compressed air (3 $Kg/cm^2$) mixed by a pipeline mixer 5. A pump for the pressure feed of the water to the mixer 5 at a pressure of 3 $Kg/cm^2$ is not shown. The water and the compressed air are mixed in a mixing ratio ranging from 1:0.2 to 1:0.4. The mixture is delivered at a high pressure through the nozzles 4 so as to be directed against the steel to complete the rinsing process.

A plurality of pipes extend in a direction perpendicular to the feed direction of the steel. Each pipe is provided with six nozzles 4, which are spaced at intervals of 10 cm. During the time when a mixture of water and compressed air is delivered through the nozzles 4, each pipe is subjected to reciprocating motion in the axial direction by means of a vibration generator 9 at a stroke length of 15 mm and at a frequency of 80 times or more per minute. The effect of the nozzles 4 upon the cleanliness of the steel is significantly greater than the case where three times as much as the mixture of water and compressed air is delivered through conventional stationary nozzles. The conventional stationary nozzles have another disadvantage that nonuniformity in the cleanliness of the steel is apt to result therefrom. The present invention solves this problem in a simple and efficient manner.

The nozzles 4 are directed against the upper and lower surfaces of the band steel respectively. If further nozzles are provided downstream of said nozzles 4, the effect upon the cleanliness of the steel will be improved.

Band steel will be effectively rinsed if the nozzles 4 are downwardly directed against the hand steel in the range where the band steel is upwardly inclined.

4) Rinsing water is pumped from each compartment of the rinsing tank 2 by a pump 6 through a filter 8 to nozzles 7 so as to be ejected against the upper and lower surfaces of the band steel. If it were not for the filter 8, the nozzles 7 would be choked up by suspended matters accumulated in the compartments of the rinsing tank 2. The accumulation of the suspended matters in the compartments of the rinsing tank 2 can be attributed to the facts that, in the salt bath furnace 1, carbonized oil sticks to the surfaces of the steel and that this carbonized oil, together with salts which likewise stick to the surfaces of the steel and are taken out of the salt bath furnace 1, is carried into the compartments of the rinsing tank 2 and accumulated therein as suspended matters.

Preferably the nozzles 7 should have a bore diameter of 0.8 mm or more.

At the feed side of the rinsing tank 2, the steel is so hot as to vaporize the rinsing water sprayed against the steel. As a result of this vaporization, the rinsing water in the upstream compartment of the rinsing tank 2 gradually decreases in quantity.

In order to make up for this loss in quantity, waste water discharged at the feed side of the rinsing tank 2 is recycled after the isolation of salts therefrom.

5) The above-described waste water discharged at the feed side of the rinsing tank 2 contains sodium hydroxide and sodium nitrate in the same ratio as those contained in the salt bath liquid. The more cleanly the steel is rinsed, the higher the concentrations of the sodium hydroxide and the sodium nitrate in the waste water will be.

6) The results of a chemical analysis on the concentrations of soluble matters in the waste water discharged at the feed side of the rinsing tank 2 were as follows:

| | |
|---|---|
| Sodium hydroxide | 1.2N (48 g/liter) |
| Sodium nitrate | 0.3N (25.5 g/liter) |
| $Cr^{6+}$ | 5500 mg/liter |
| Mn | 1800 mg/liter |
| Fe | 1 mg/liter |
| Ni | 4 mg/liter |

Figure 3:
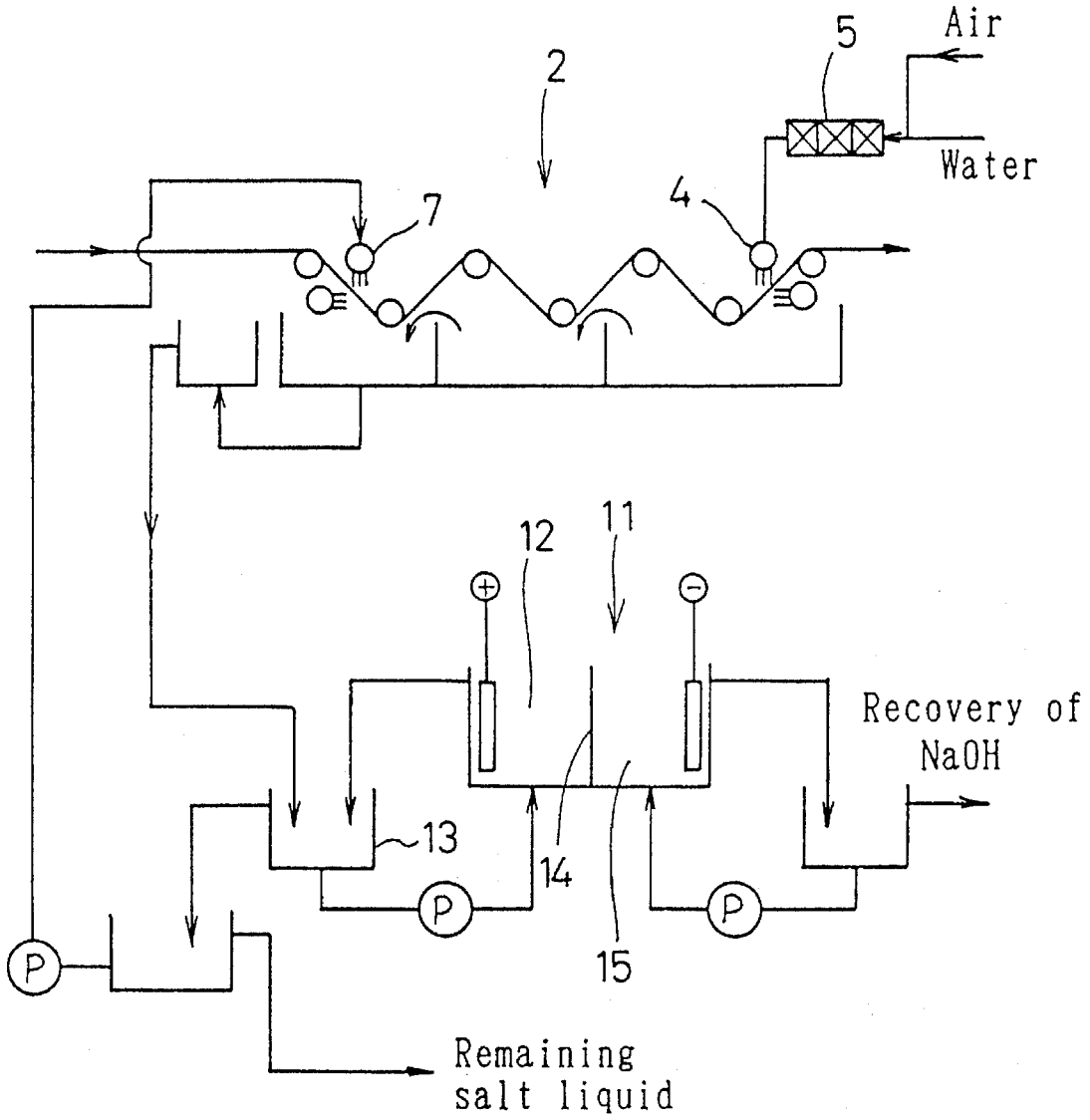
FIG. 3 is a view to help explain how free alkalis are recovered from waste water discharged at one end of the rinsing tank shown in FIG. 2.

As shown in FIG. 3, this waste water is continuously fed to a circulating tank 13 and then to an anode compartment 12 of an electrolyzer 11. The anode compartment 12 is separated from a cathode compartment 15 by means of a cation exchange membrane 14. Sodium ions contained in the waste water are subjected to electrophoresis from the anode compartment 12 to the cathode compartment 15 and enriched in the latter with the lapse of time. The concentration of sodium ions in the cathode compartment 15 depends on the concentration in the anode compartment 12. If the latter is high enough, the former can be higher than the latter 7) Waste water refluxed from the anode compartment 12 to the circulating tank 13 contains $Na^+$ only in a low concentration, because many of the sodium ions have been subjected to electrophoresis from the anode compartment 12 to the cathode compartment 15. This waste water is returned to nozzles 7 disposed at the upstream end of the rinsing tank 2 and used for rinsing the steel again. Salts, which stick to the surfaces of the steel, are removed from the surfaces of the steel again and dissolved in rinsing water again. As a result of vaporization, the rinsing water is enriched again. Now the rinsing water can be fed to the anode compartment 12 again. On the same parameters as mentioned in paragraph 6), a second chemical analysis was conducted 4 hours after the waste water began to be circulated, and the following results were obtained:

| | |
|---|---|
| Sodium hydroxide | 1.2N (48 g/liter) |
| Sodium nitrate | 1.5N (127.5 g/liter) |
| $Cr^{6+}$ | 27500 mg/liter |
| Mn | 9000 mg/liter |

It was ascertained that the product quality was stabilized as long as the waste water in circulation was kept in the abovedescribed condition.

8) The waste water in the anode compartment 12 is alkaline as long as the rinsing tank 2 and the electrolyzer 11 are free of any abnormal condition. In the event of an abnormal condition which causes the concentrations of salts in the anode compartment 12 to be lowered, an excessively large quantity of sodium ions will be subjected to electrophoresis to the cathode compartment 15 to such an extent that the waste water in the anode compartment 12 becomes acidic to the detriment of the characteristics of the cation exchange membrane 14. By way of precaution against the occurrence of such an abnormal condition, a lookout for the pH-values of the waste water not only in the cathode compartment 15 but also in the anode compartment 12 is of obvious importance.

9) Anions are accumulated in the waste water in the anode compartment 12 as sodium ions are removed therefrom. This waste water is fed to the pickling bath 3, in which $Cr^{6+}$ is reduced to $Cr^{3+}$ and $Mn^{5+}$ is reduced to $Mn^{2+}$ by the reducing power of ferrous ions ($Fe^{2+}$) accumulated in the pickling bath 3. $Cr^{3+}$ and $Mn^{2+}$ function as cations in acidic liquid.

An example of pickling liquor was composed of 0.5N free nitric acid, 0.6N free hydrofluoric acid, 0.6N ferrous ions and 0.25N ferric ions ($Fe^{3+}$). Ferrous ions were allowed to increase at the rate of 100N per hour under the condition that 10 $m^3$ of the pickling liquor was held at a temperature ranging from 50° C. to 55° C. An injection of waste water containing 27.5 g $Cr^{6+}$ per liter (3.2N) was given to this pickling liquor at the rate of 10 liters per hour. Five hours later, an attempt was made to determine the concentration of $Cr^{6+}$ in the pickling liquor, but $Cr^{6+}$ was not detectable. Instead of $Cr^{6+}$, the concentration of $Cr^{3+}$ was found to be 2.81 g/liter, indicating that $Cr^{6+}$ was completely reduced by ferrous ions accumulated in the pickling bath 3. Stainless steel 300 according to the Japanese Industrial Standards (JIS) was immersed in this pickling liquor for the purpose of descaling. After immersion, the stainless steel was found to be free of scale and have an allowable surface finish. This stainless was compared with steel pickled in calcium chloride solution, and was found to be much superior thereto in corrosion resistance.

Figure 4:
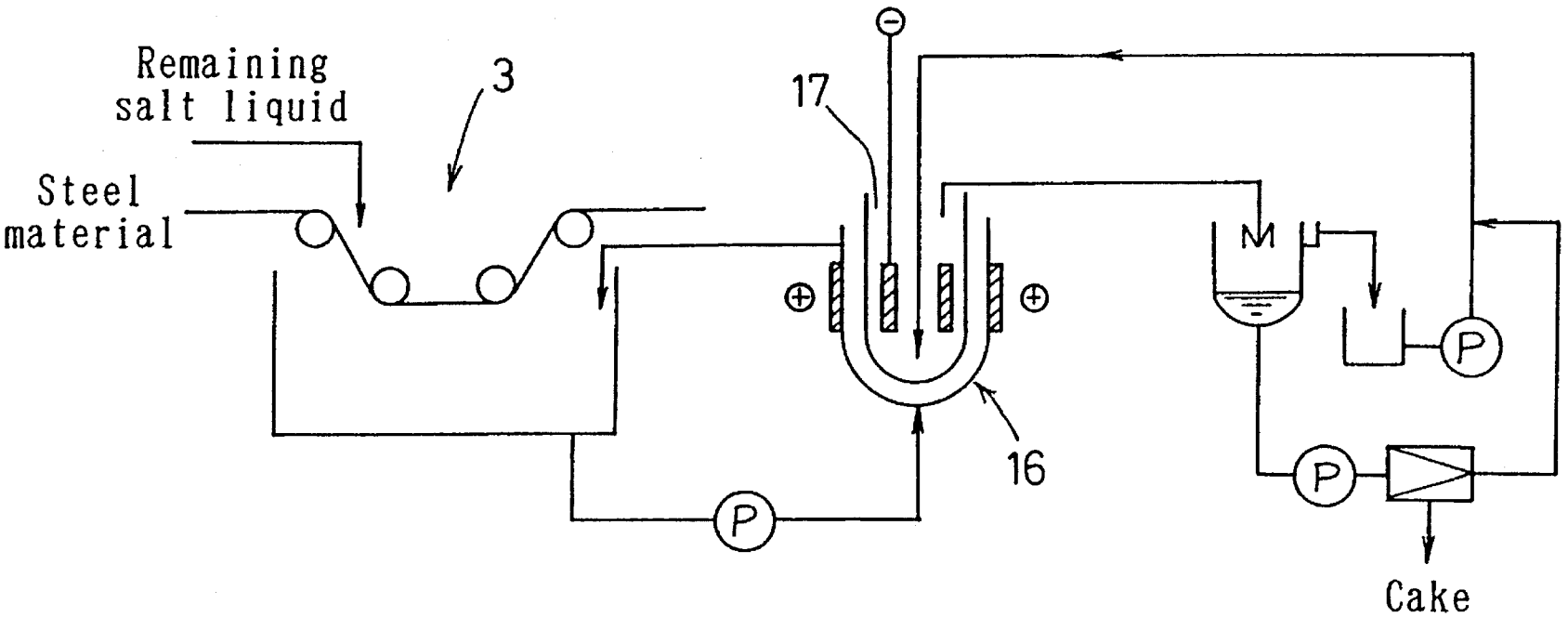
FIG. 4 is a view to help explain how metallic salts accumulated in the pickling bath included in FIG. 1 are subjected to ionization.

10) The above-described reduced metal ions, together with other metal ions accumulated in the pickling bath 3, have to be removed from within the pickling bath 3. A known method suitable for this purpose, as described in Japanese Patent Unexamined Publication No. 1-234582, is characterized in that a cathode compartment 17 (FIG. 4) of an electrolyzer 16 contains alkaline liquid and is separated from an anode compartment by means of a cation exchange membrane, and that cations accumulated in acid bath liquid are subjected to electrophoresis to the cathode compartment 17, converted into insoluble metallic salts, and precipitated so as to be removed from the process unit.

Figure 5:
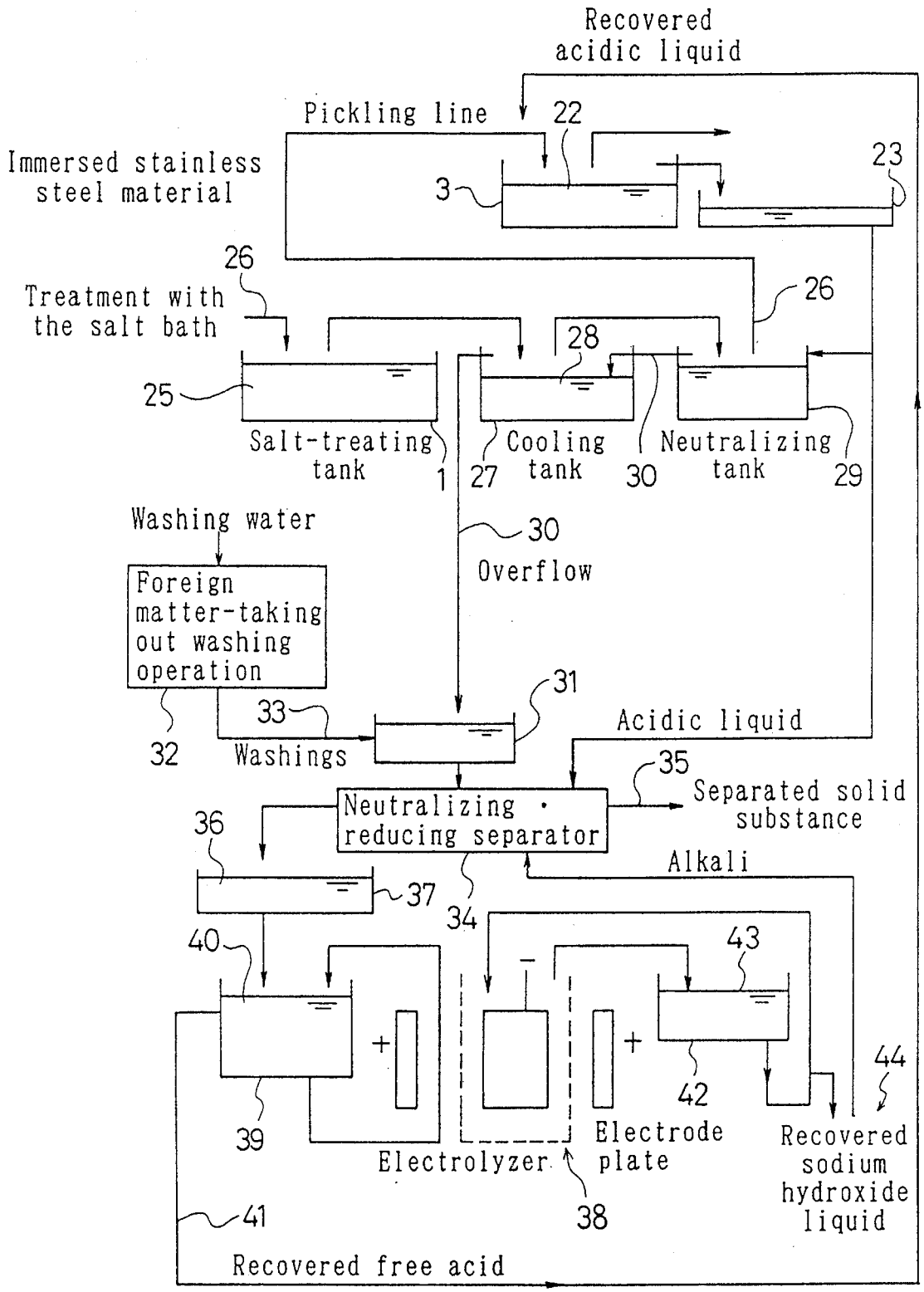
FIG. 5 is a view illustrating the construction of another embodiment of the present invention.

11) In FIG. 5 which illustrates another embodiment of the present invention, pickling liquor 22 contained in the pickling bath 3 and used for pickling stainless steel was composed of 2.3N nitric acid and 0.57N iron, of which ferric ions ($Fe^{3+}$) accounted for 70%. A waste liquor collecting pan 23 is disposed close up to the pickling bath 3 so as to receive waste liquor as it spills out of the pickling bath 3.

12) The composition of salt bath liquid 25 contained in the salt bath furnace 1 was 70% solid sodium nitrate and 30% solid sodium hydroxide heated to and held at a temperature ranging from 400° C. to 600° C. so as to be allowed to remain in a molten state. Stainless steel 26 (SUS 304 according to JIS) was immersed in this salt bath liquid 25 and then in coolant 28 contained in a quenching bath 27 so that scale formed on the surfaces of the stainless steel 26 may be made porous and easily descaled in the succeeding pickling process.

The coolant 28 contained 50 g nitric acid radicals per liter, 34 g sodium salts per liter, 2000 ppm of $Cr^{6+}$, and 5000 ppm of iron hydroxide. The pH of the coolant 28 was about 13, indicating that the coolant 28 was a strong base.

13) Then the stainless steel 26 was fed to a neutralizing tank 29, in which alkalis sticking to the surfaces of the cooled stainless steel 26 were neutralized by the pickling liquor 22 supplied from the waste liquor collecting pan 23.

14) Neutralization by the pickling liquor 22 was found to be superior to neutralization by water which is well known in the art as conventional. The pickling liquor 22 had a marked effect even on alkalis permeating the porous scale.

Waste liquor 30 spilling out of the neutralizing tank 29 was supplied to the quenching bath 27. This waste liquor 30 contained a large quantity of soluble sodium nitrate, sodium hydroxide and other metal hydroxides.

15) The waste liquor 30 was stored in a storage tank 31 in order to recover the agents contained in the waste liquor 30.

On the other hand, insoluble metal oxides and siliceous sand collecting at the bottom of the salt bath furnace 1 were taken out and washed. Wash water 33 used for this washing contained salts and chromium compounds which had stuck to the insoluble metal oxides and the siliceous sand. In order to prevent these salts and chromium compounds from leaking out, the wash water 33 was also stored in the storage tank 31.

The waste liquor 30 and the wash water 33 stored in the storage tank 31 were neutralized by the pickling liquor 22 supplied from the waste liquor collecting pan 23, while $Cr^{6+}$ was reduced to $Cr^{3+}$ by $Fe^{3+}$ remaining in the pickling liquor 22. This reduction was monitored by a means for measuring redox potential soaked in a chemical reactor allotted for this reduction. The waste liquor 30 and the wash water 33 in this chemical reactor were held at a temperature ranging from 40° C. to 50° C. or at a higher temperature.

Then, in order to convert the dissolved metal ions into insoluble matters 35, an alkaline agent was added to the waste liquor 30 and the wash water 33 in the chemical reactor. The insoluble matters 35 were isolated from the waste liquor 30 and the wash water 33 in a separator 34. Filtrate 36 thus obtained was stored in a storage tank 37.

16) The filtrate 36 was fed to a circulating tank 39 attached to an anode compartment of an electrolyzer 38, in which the filtrate 36 was subjected to electrolysis as an electrolytic solution 40, from which a free acid solution 41 was recovered. The electrolyzer 38 was provided with an ion exchange membrane by which a cathode compartment was separated from the abovementioned anode compartment. A circulating tank 42 attached to the cathode compartment contained a solution 43, from which a sodium hydroxide solution 44 was recovered.

17) The free acid solution 41 contained 2.5N nitric acid, which could be reused as pickling liquor.

Since the sodium hydroxide solution 44 contained 2.7N sodium hydroxide, this solution 44 was recycled for neutralizing the waste liquor 30 and the wash water 33 after reduction in the above-described chemical reactor.

What is claimed is:

1. In a method of treating salt bath liquid used for surface treatment of steel, said surface treatment of steel comprising the steps of:

providing a salt bath furnace containing said salt bath liquid;

immersing said steel in said salt bath liquid for surface treatment;

withdrawing said steel from said salt bath liquid; immersing said steel in cooling water of a cooling bath to cool said steel;

withdrawing said steel from said cooling bath;

immersing said steel in a neutralizing liquid of a neutralizing bath for neutralizing alkalis sticking to the surface of said cooled steel;

withdrawing said steel from said neutralizing liquid bath;

immersing said steel in a pickling liquid of a pickling bath for pickling said steel;

the improvement comprising:

washing foreign matter, sedimented from a bottom portion of said salt bath furnace and withdrawn from said furnace, by means of washings;

providing a storage tank;

storing said cooling water flowing from said cooling bath, said neutralizing liquid flowing from said neutralizing bath, and said washings used for said washing, in said storage tank;

taking out a portion of said pickling liquid from said pickling bath;

taking from said storage tank said cooling water, neutralizing liquid, and washings, and combining them with said portion of pickling liquid, thereby reducing hexavalent salts contained in said combined liquid to trivalent salts whereby said combined liquid is reduced;

adding sodium hydroxide to said reduced liquid, thereby converting metal ions remaining in said reduced liquid into insoluble metal hydroxides and isolating said insoluble metal hydroxides from said reduced liquid; and feeding said liquid from which said insoluble metal hydroxides are isolated to an electrolyzer for recovering sodium hydroxide.

2. A method of treating salt bath liquid as set forth in claim 1, wherein:

said electrolyzer has a cation exchange membrane as an ion-selectively separating partition diaphragm between an anode chamber and a cathode chamber; and a voltage is applied between the anode and cathode of said electrolyzer for recovering a free acid from said anode chamber and sodium hydroxide from said cathode chamber, said recovered free acid being fed to said pickling bath and said recovered sodium hydroxide being utilized for said addition to said reduced liquid.

* * * * *